US005799531A

United States Patent [19]

Orcutt et al.

[11] Patent Number: 5,799,531

[45] Date of Patent: Sep. 1, 1998

[54] CRIMPER FITTING LOCATOR ASSEMBLY

[75] Inventors: Eric D. Orcutt, Rockvale; Dean D. Fritz, Murfreesboro, both of Tenn.

[73] Assignee: Dana Corporation, Toledo, Ohio

[21] Appl. No.: 710,297

[22] Filed: Sep. 17, 1996

[51] Int. Cl.[6] ..... B21D 39/04

[52] U.S. Cl. ..... 72/402; 72/461; 29/237

[58] Field of Search ..... 72/402, 461, 452.1; 29/237

[56] References Cited

U.S. PATENT DOCUMENTS

| | | | |
|---|---|---|---|
| 441,822 | 12/1890 | Browning . | |
| 2,231,278 | 2/1941 | Miller . | |
| 2,311,662 | 2/1943 | Hunziker | 29/237 |
| 3,335,594 | 8/1967 | Peterman et al. . | |
| 3,568,494 | 3/1971 | Geisman | 29/237 |
| 3,977,065 | 8/1976 | Johnson . | |
| 4,014,202 | 3/1977 | Van Allen et al. . | |
| 4,034,592 | 7/1977 | Chen | 29/237 |
| 4,107,964 | 8/1978 | Smith . | |
| 4,244,091 | 1/1981 | Kimble | 29/237 |
| 4,781,055 | 11/1988 | Phipps . | |
| 4,866,973 | 9/1989 | Hoff . | |
| 4,885,928 | 12/1989 | Davis | 29/237 |
| 4,886,975 | 12/1989 | Murakami et al. . | |
| 4,887,451 | 12/1989 | Hoff et al. . | |

FOREIGN PATENT DOCUMENTS

| | | | |
|---|---|---|---|
| 1810715 | 4/1993 | U.S.S.R. | 72/402 |

*Primary Examiner*—Daniel C. Crane

*Attorney, Agent, or Firm*—Millen, White, Zelano, & Branigan, P.C.

[57] ABSTRACT

A crimping device for crimping end fittings on hoses and tubes includes a base ring and a pressure ring. The base ring includes a frustoconical inner surface in which is positioned a die assembly which, at its opposite end, abuts a portion of the pressure ring. When the pressure ring is pushed toward the base ring, the dies converge, crimping the fitting to the hose or tube. In order to properly locate the hose or tube, a locator pin is affixed to the pressure ring by an L-shaped bracket. The locator pin, pressure ring and crimping die assembly form a tool package which, upon being initially set, does not have to be reset for subsequent uses. The tool package can be stored while other tool packages of a similar configuration are set, used and then stored for subsequent use. In this way, the irritation and resulting inefficiency of having to continually reset tooling is minimized.

13 Claims, 3 Drawing Sheets

CRIMPER FITTING LOCATOR ASSEMBLY

FIELD OF THE INVENTION

The present invention relates to a crimper fitting locator assembly. More particularly, the present invention relates to a crimper fitting locator assembly useful for in-the-field crimping of metallic fitting assemblies onto the ends of elastomeric tubing or hose.

BACKGROUND OF THE INVENTION

Crimping dies, also known as contractible collets, operate by plastically deforming or crimping an outer metallic sleeve of a fitting around a hose end to cause the hose end to be crimped between the outer sleeve and a fitting nipple positioned inside of the hose. These devices are particularly suited for relatively low volume work such as, for example, making replacement hoses in the field or at the point of use. Exemplary of such devices are U.S. Pat. 4,887,451 and 4,886,975, both of which are assigned to the assignee of the present invention and both of which are incorporated herein by reference.

Normally, these types of crimping devices include a location device for positioning the hose and fitting. It is necessary to reset the location device each time the crimping dies, which comprise the tooling package, are replaced. This reset step, performed each time there is a change of tooling, is a somewhat time-consuming operation which decreases efficiency.

SUMMARY OF THE INVENTION

The present invention is directed to an apparatus for crimping a collar of a hose fitting to a hose wherein the apparatus includes a base ring having an internal camming surface, a pressure ring normally biased away from the base ring and a crimping die assembly disposed within the base ring and engaged by the internal camming surface of the base ring. A locating pin is fixed to the pressure ring and moves with the pressure ring toward the base ring during the crimp. Prior to performing the crimp, the collar and hose are slid onto the locating pin to correctly position the collar and hose with respect to the crimping dies. The pressure ring is then pushed toward the base ring to force the crimping die assembly inwardly to accomplish the crimp. By fixing the locating pin on the pressure ring, the crimping die assembly can be removed with the pressure ring and locating pin as a package and then used at a later time without having to reset the locating device.

In a more specific aspect, the locating pin is mounted adjustably on a support for adjustment in the axial direction and includes a stop fix thereon to determine the axial location of the hose and hose fitting with respect to the locating pin and the crimping dies.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION OF A PREFERRED EMBODIMENT

Figure 1:
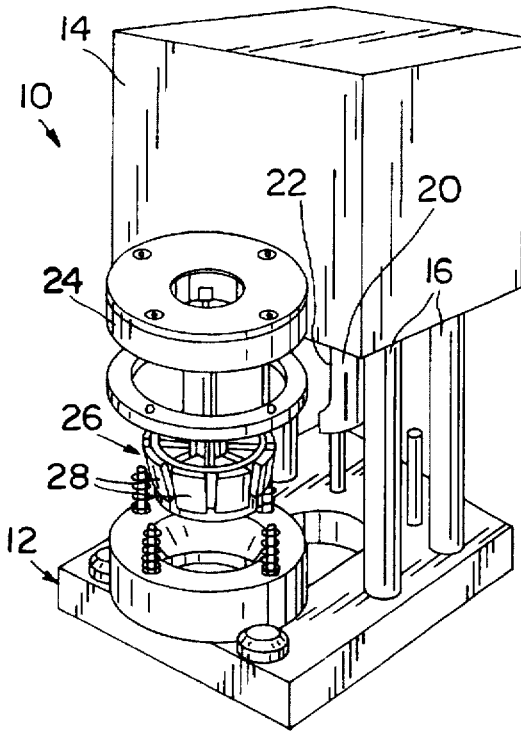
FIG. 1 PRIOR ART
FIG. 1 is a front exploded view, partially in perspective, of a prior art crimping device.

Referring now to FIG. 1, a portable, field operated, crimping device 10 is shown which includes a bed plate 12 and a hydraulic ram actuator assembly 14 affixed to and supported over the bed plate by columns 16. A pair of rear supports 18 are utilized to provide additional stability to the portable device 10. The crimping device 10 includes a hydraulic ram 20 which moves reciprocally in a vertical direction as it is driven by the hydraulic actuator assembly 14. The ram includes a clearance slot 22 which is provided to accommodate radially extending portions of items being crimped. Within the ram 20 there is a space 23.

Figure 2:
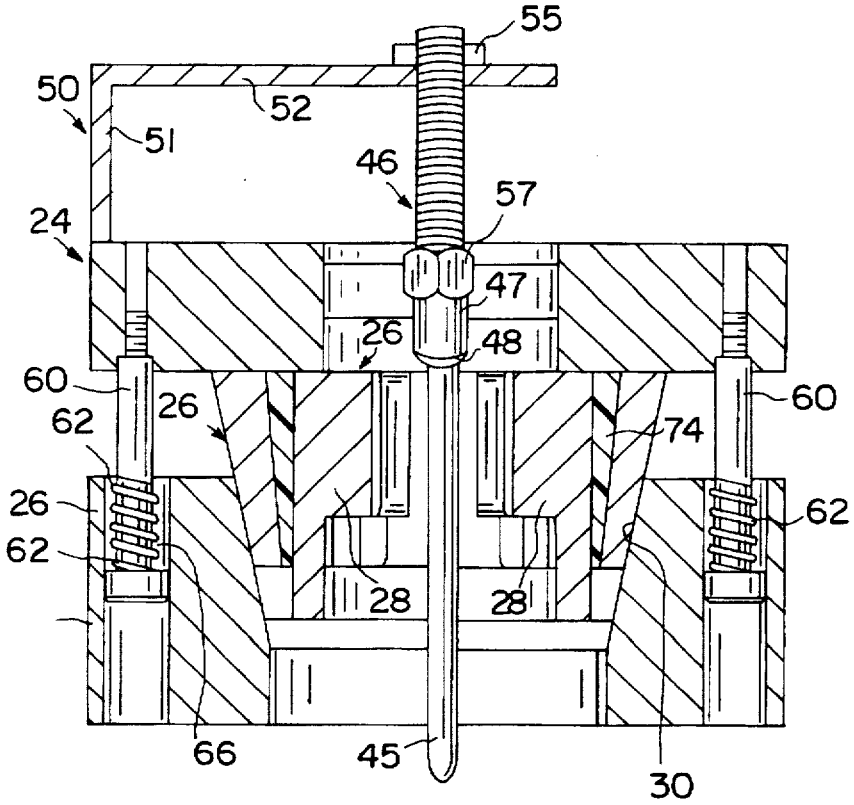
FIG. 2 is an enlarged cross-sectional view of apparatus comprising a portion of the prior art crimping device of FIG. 1, but showing the device in combination with the locator pin in accordance with the present invention.
Figure 3:
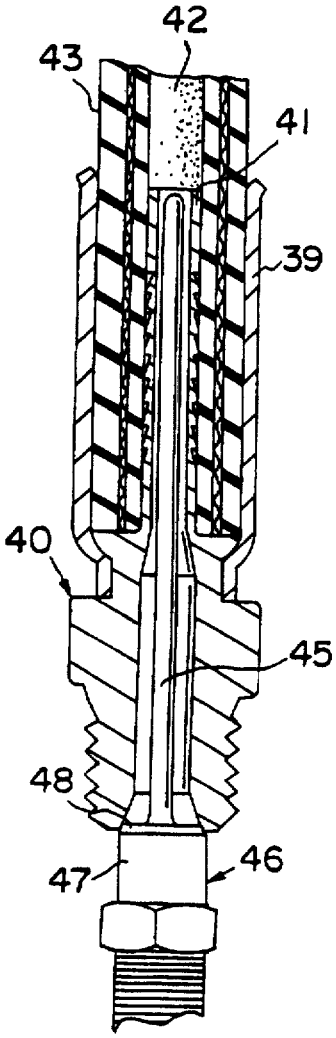
FIG. 3 is a side view showing a fitting disposed on the locating pin prior to crimping.
Figure 4:
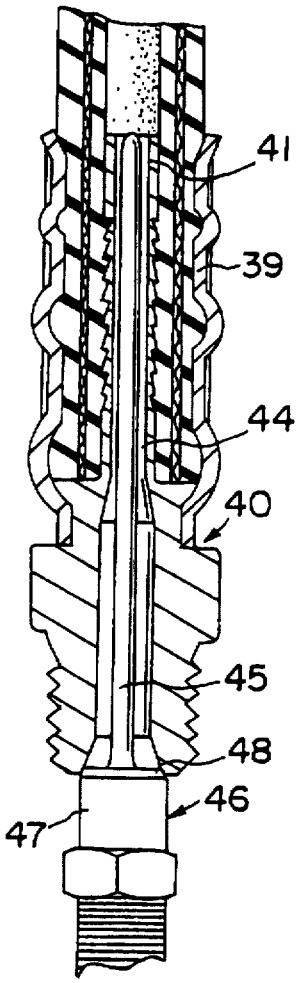
FIG. 4 is a view similar to FIG. 3, but showing the fitting after crimping.

Referring now to FIGS. 2–4 in combination with FIG. 1, the ram 20 is adapted for making contact with a pressure ring 24 which in turn makes contact with a crimping die assembly 26. The crimping die assembly 26 includes a set of two die segments 28. The crimping die assembly 26 is received in a frustoconical opening 30 in a base ring 32. As the pressure ring 24 is pushed by the ram 20 toward the base ring 32, the die segments 28 are pushed inwardly to deform a collar 39 of an end fitting 40 (see FIGS. 3 and 4). The end fitting 40 has a nipple 41 which extends within the hollow core 42 of a reinforced hose 43. The end fitting 40 also has a bore 44 therethrough which extends through the nipple 41.

In accordance with the principles of the present invention, the bore 44 receives a shank 45 of a locating pin 46. The locating pin 46 has a collar 47 thereon which provides a shoulder 48 that engages the end of the fitting 40. As will be explained further hereinafter, the locating pin 46 is fixed on the pressure ring 24 so as to move with the pressure ring as the pressure ring is advanced toward the base ring 32. The crimping die assembly 26 deforms the crimping collar 39 as is shown in FIG. 4 as the pressure ring 24 moves downwardly.

Figure 5:
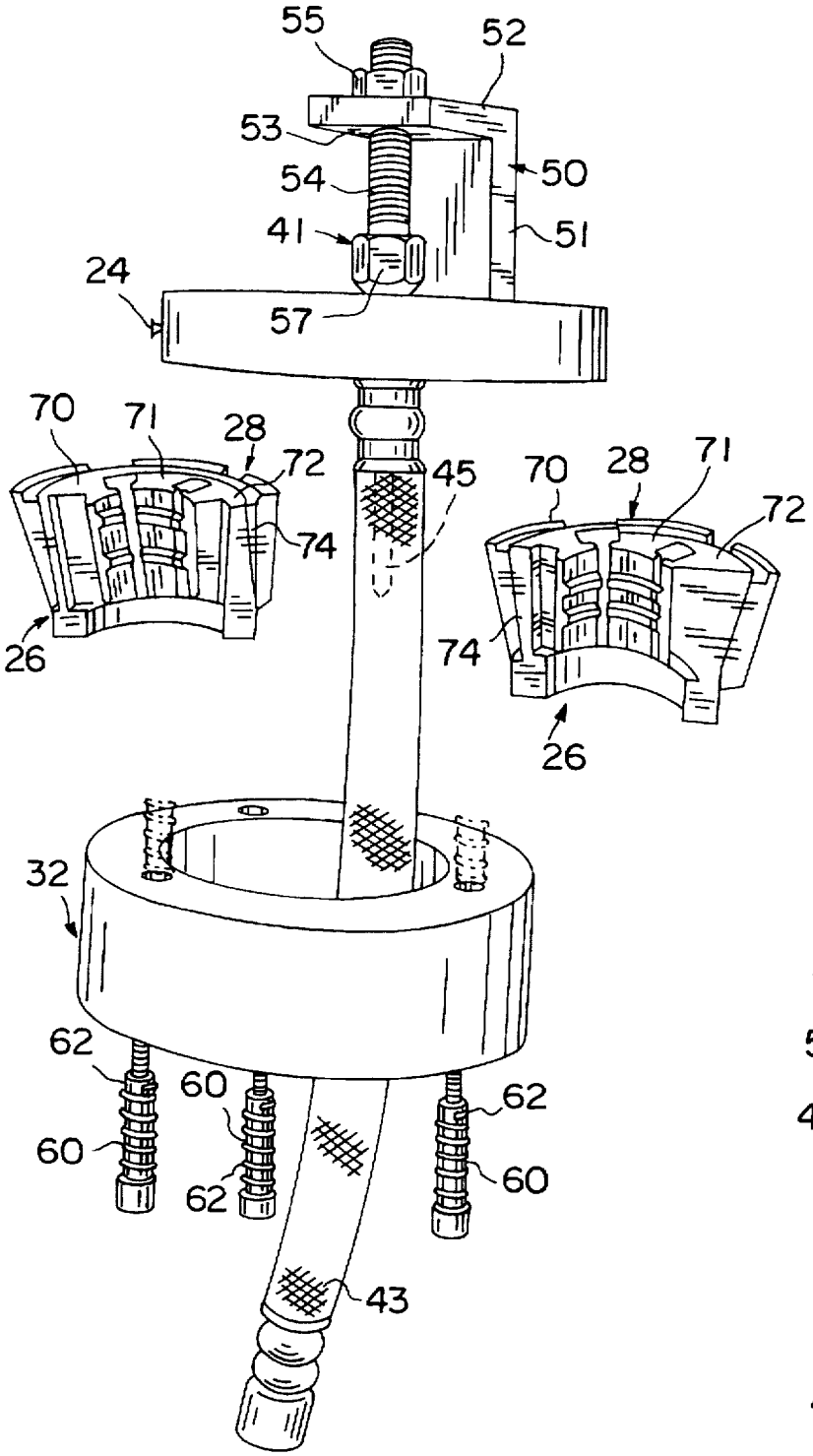
FIG. 5 is an exploded view showing the components of the crimping apparatus of FIG. 2.
Figure 6:
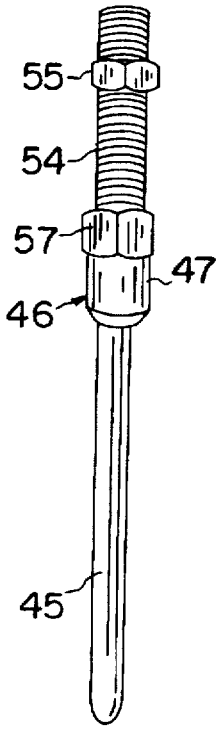
FIG. 6 is a side view of a locating pin used in the crimping apparatus.

Referring now mainly to FIGS. 5 and 6, it is seen that the pressure ring 24 has fixed thereon an L-shaped bracket 50 comprised of a vertical leg 51 and a horizontal leg 52 affixed to the vertical leg. The bracket 50 extends into the space 23 within the ram 20 (see FIG. 1). The horizontal leg 52 has a threaded bore 53 therein which threadably receives a threaded tube 54. The threaded tube 54 has a nut 55 threaded thereon to affix the threaded tube with respect to the horizontal leg 52 so that the threaded tube 54 reciprocates with the pressure ring 24. The threaded tube 54 supports shank portion 45 of the locating pin 46 which is held in place by a hex nut 57 positioned against the collar 47 of the locating pin.

As is seen in FIG. 5, the pressure ring 24 is supported on the base ring by pins 60 each of which is surrounded by a coil spring 62 which extends between the base ring 32 and the bottoms 64 of bores 66 into which the coil springs 62 collapse as the pressure ring is urged downwardly by the ram 20.

In accordance with a preferred embodiment of the invention, the crimping die assembly 26 is comprised of two die segments 28 with each die segment 28 including three die sectors 70, 71 and 72. The three die sectors 70, 71 and 72 are joined by elastomeric backings 74 which deform to allow the crimping die assembly 26 to be squeeze as the pressure ring 24 moves toward the base ring 32 to effect the crimp. After the crimp is accomplished, the elastomeric backings 74 expand to spread the die sectors 70, 71 and 72 of die segments 28 apart as the pressure plate 24 moves away from the base plate 32. While three die sectors are shown, the die segments 28 may also have four die sectors each.

By using the aforedescribed arrangement, tooling assemblies which each comprises the crimping die assembly 26, the pressure ring 24 and the locating pin 46 can be set, removed and stored for reuse without any additional reset. When it is desired to change tooling assemblies the tooling mounted tooling assembly is removed and stored until needed again, while a different tool tooling assembly is inserted and set and if not previously set. By utilizing this arrangement, the convenience and efficiency of the crimping machine 10 is enhanced.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. An apparatus for crimping a crimping collar of a hose fitting to a hose, the apparatus comprising:

a base ring formed about an axis, the base ring having an internal camming surface;

a plurality of tooling assemblies individually mountable on the base ring, wherein each tooling assembly includes a crimping assembly comprising:

a pressure ring axially aligned with the base ring and defining a die engaging surface, the pressure ring being detachably mounted on the base ring;

a locating pin positioned on the pressure ring and aligned with the axis of the base ring, the locating pin having a shank portion extending through the base ring so as to be surrounded thereby and being adapted to receive therearound the hose and hose fitting in an uncrimped state;

an adjustable coupling for fixing the axial position of the locating pin with respect to the pressure ring;

a crimping die assembly having a first end and a second end being detachably mounted on the base, the first end being axially restrained by the die engaging surface of the pressure ring and the second end being disposed within the base ring for engagement by the internal camming surface thereof, the crimping die assembly having a crimping surface surrounding, coaxial with and in radial spaced relation with the locating pin, wherein upon moving the pressure ring toward the base ring, the crimping die assembly is squeezed inwardly toward the crimping collar and crimps the collar to the hose while the hose and hose fitting are restrained and positioned by the locating pin;

whereby each crimping assembly is adjustable for a selected crimping collar and is mountable on the base to crimp the selected crimping collar.

2. The apparatus of claim 1, wherein the locating pin is mounted by an adjustable coupling on a support connected to the pressure ring for adjustment in the axial direction.

3. The apparatus of claim 2, wherein the adjustable coupling for the locating pin has a stop affixed thereon to determine the axial location of the hose fitting with respect to the locating pin.

4. The apparatus of claim 3, wherein the locating pin is threadably mounted with respect to the pressure ring to determine the axial location of the stop with respect to the pressure ring and to the crimping surface of the die assembly.

5. The apparatus of claim 4, wherein the pressure ring includes a bracket affixed thereto which has a portion extending radially across the axis for threadably mounting the locating pin therein.

6. The apparatus of claim 5, wherein the pressure ring defines a circular opening and wherein the support surface thereof is adjacent to the circular opening with portions of the crimping die assembly being within the circular opening.

7. The apparatus of claim 6 further including a plurality of mounting pins received in bores through the base ring and affixed to the pressure ring wherein the pins slide in the bores of the base ring as the pressure ring moves toward the base ring when squeezing the crimping die assembly.

8. The apparatus of claim 7, wherein the crimping die assembly is comprised of two sets of dies, each set of dies having three or four die sectors affixed to an elastic backing.

9. The apparatus of claim 8 wherein the locating pin is threadably mounted with respect to the pressure ring wherein the axial location of the stop with respect to the pressure ring and to the crimping surface of the die assembly is adjustable.

10. The apparatus of claim 1, wherein the pressure ring includes a bracket affixed thereto which extends radially across the axis for threadably mounting the locating pin.

11. The apparatus of claim 2, wherein the support retains the locating pin at a position located in axial spaced relation with respect to the pressure ring.

12. The apparatus of claim 11, wherein the support is an L-shaped bracket.

13. The apparatus of claim 12, wherein the L-shaped bracket has a first leg fixed to the pressure ring and extending in an axial direction and a second leg extending in a radial direction with the locating pin being adjustably attached to the second leg.

* * * * *